US007819704B1

(12) United States Patent
Su

(10) Patent No.: US 7,819,704 B1
(45) Date of Patent: Oct. 26, 2010

(54) CONNECTOR PLUG WITH MOVABLE CONDUCTING POLE

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/638,991

(22) Filed: Dec. 16, 2009

(30) Foreign Application Priority Data

Apr. 3, 2009 (CN) ..... 2009 1 0301350

(51) Int. Cl.
*H01R 13/42* (2006.01)

(52) U.S. Cl. ..... 439/737; 439/131; 439/171; 439/692; 439/693; 439/695; 439/696; 439/697

(58) Field of Classification Search ..... 439/171, 439/131, 692, 693, 695, 696, 697, 737
See application file for complete search history.

(56) References Cited

U.S. PATENT DOCUMENTS

| | | | | |
|---|---|---|---|---|
| 2,472,690 | A * | 6/1949 | Atherton et al. | 439/737 |
| 2,716,737 | A * | 8/1955 | Maberry | 439/176 |
| 2,716,740 | A * | 8/1955 | Parish | 439/454 |
| 2,779,930 | A * | 1/1957 | Archer | 439/692 |

* cited by examiner

*Primary Examiner*—Tho D Ta
(74) *Attorney, Agent, or Firm*—Frank R. Niranjan

(57) ABSTRACT

A connector plug comprises a shell defining at least two threaded holes. At least two conducting poles are set in an interior of the shell and corresponding to the at least two threaded holes. Each conducting pole comprises a pin extended from the interior of one of the at least two threaded holes. One cable is electronically connected to the pin, and one fixing portion is disposed on the cable and adjacent to the pin, and is received into the threaded hole.

8 Claims, 5 Drawing Sheets

CONNECTOR PLUG WITH MOVABLE CONDUCTING POLE

BACKGROUND

1. Technical Field

The present disclosure relates to a connector plug.

2. Description of Related Art

Often, when plugging a electrical device into a power outlet, a power extension, some receptacles on the outlet or extension may be blocked because of the size and shape of the connecting plug of the electrical device.

Therefore, what is needed is a connector plug to overcome the above problem.

DETAILED DESCRIPTION

Figure 1:
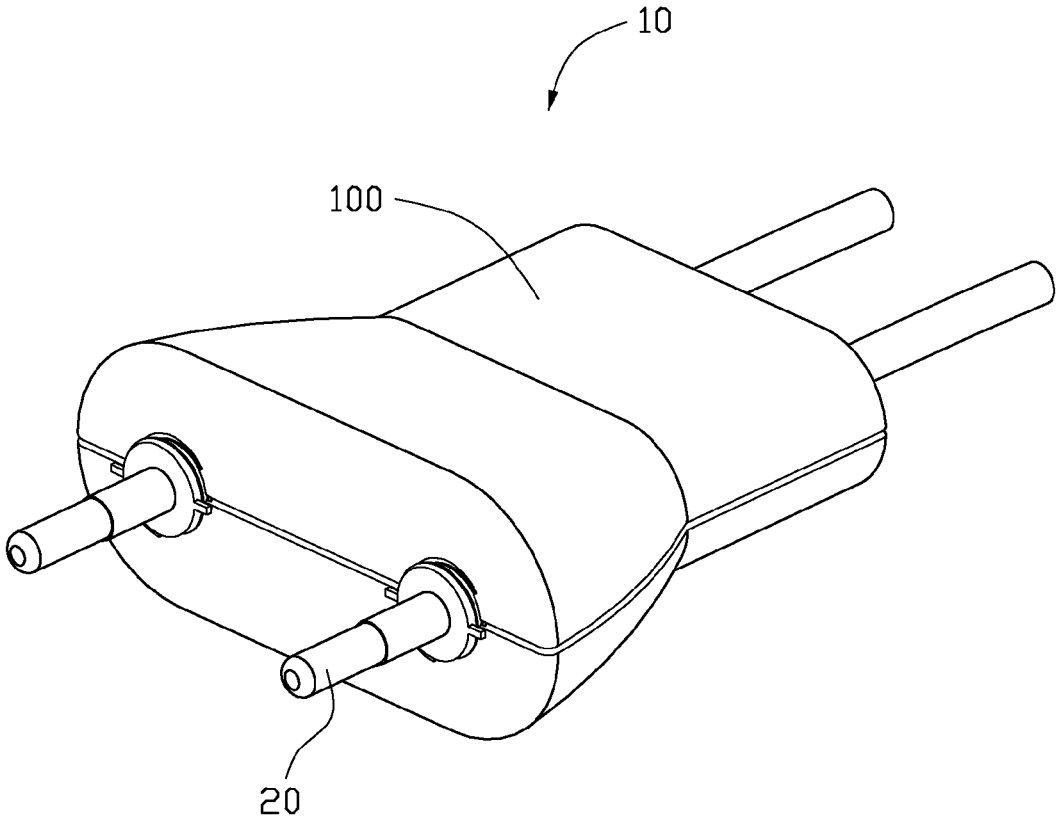
FIG. 1 is an isometric view of a connector plug in accordance with an exemplary embodiment.

Referring to FIG. 1, a connector plug 10 is provided. The connector plug 10 includes a shell 100 and at least two conducting poles 20. In the exemplary embodiment, the number of the at least two conducting poles 20 is two.

Figure 2:
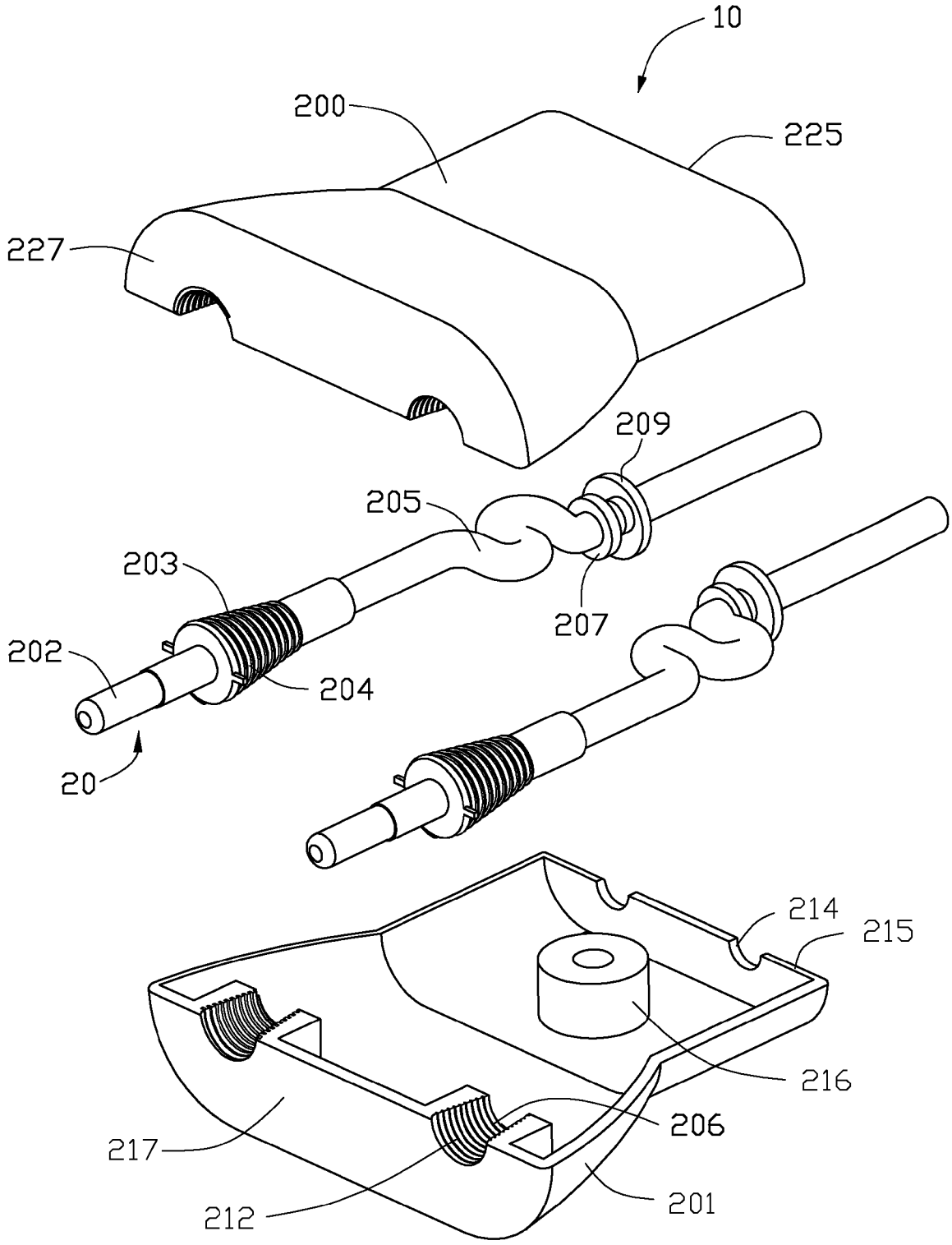
FIG. 2 is an exploded view of the connector plug of FIG. 1.
Figure 3:
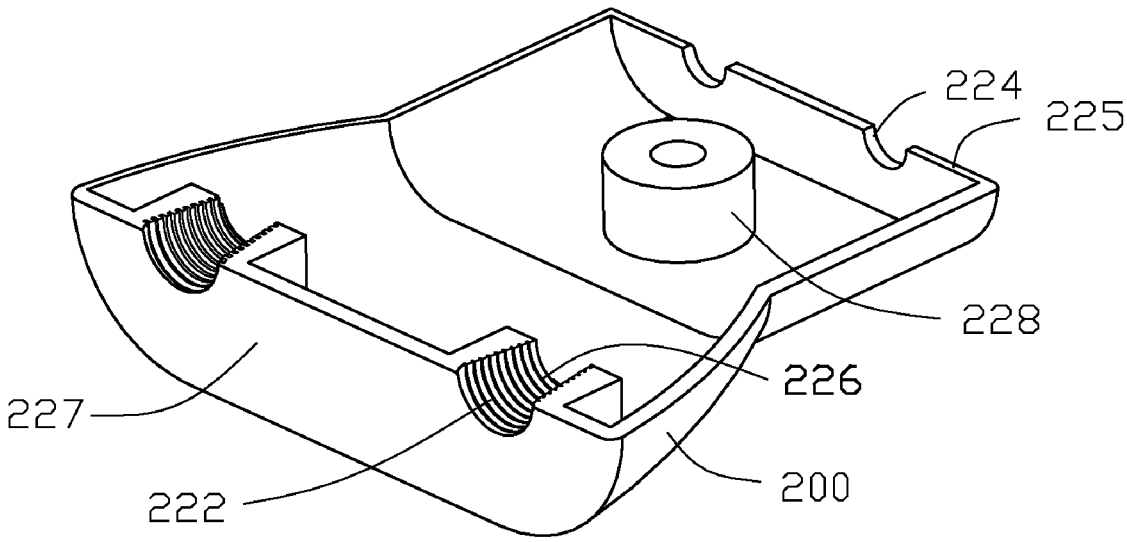
FIG. 3 is an isometric view of a upper shell of the shell of FIG. 1, viewed from an another aspect.

Referring to FIGS. 2-3, the shell 100 includes an upper shell 200 and a lower shell 201. The upper shell 200 includes a sidewall 225 and a sidewall 227 opposite to the sidewall 225. Two first cutouts 224 are defined in the sidewall 225. Two first threaded grooves 222 are defined in the sidewall 227. The size of the first threaded groove 222 gradually increases along a direction away from the first cutouts 224. A screw pole 228 is protruded from the surface of the upper shell 200. The lower shell 201 includes a sidewall 215 and a sidewall 217 opposite to the sidewall 215. Two-second cutouts 214 are defined in the sidewall 215, to cooperate with the first cutouts 224 to form two circularity shaped holes. Two second threaded grooves 212 are defined in the sidewall 217, and the size of each second threaded groove 212 gradually increases along a direction away from the second fixing hole 214. Each second threaded groove 212 cooperates with a corresponding first threaded groove 222 to form a frustum shaped hole. A screw pole 216 is protruded from the surface of the lower shell 201, and is corresponding to the screw pole 228. In the exemplary embodiment, the size of each first cutout 224 equals to the size of each second cutout 214, and the size of each first threaded groove 222 equals to the size of each second threaded groove 212.

Figure 4:
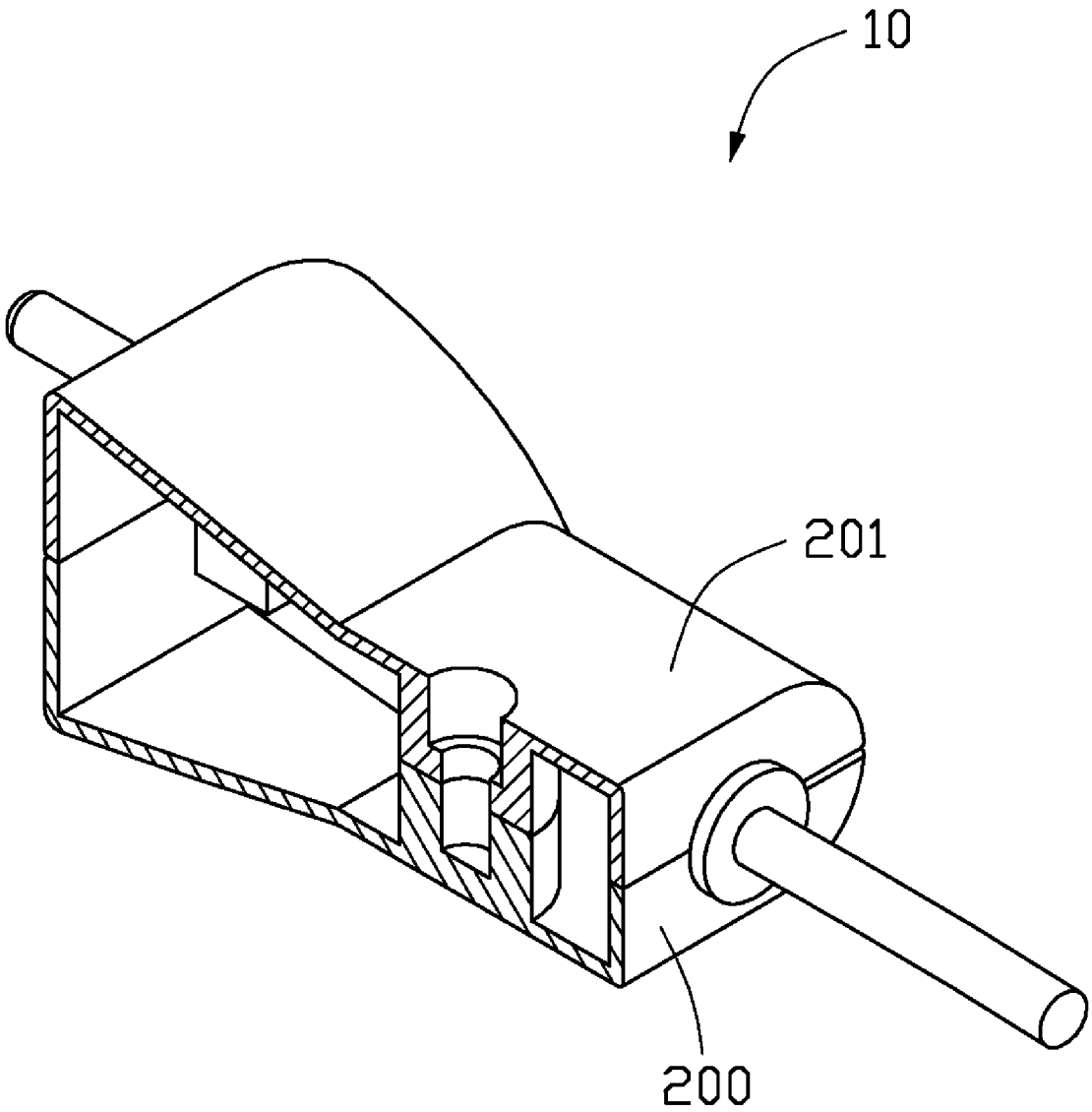
FIG. 4 is a cross-sectional view of the shell of FIG. 1, taken along the line IV-IV.

Referring to FIG. 4, the first cutout 224 of the upper shell 200 cooperates with the second cutout 214 of the lower shell 201, the first threaded groove 222 of the upper shell 200 cooperates with the second threaded groove 212 of the lower shell 201, and the screw pole 228 resists to the screw pole 216, to form the connector plug 10.

The conducting pole 20 includes a pin 202, a cable 205, and a threaded fixing portion 203. The cable 205 is electrically connected to the pin 202. The threaded fixing portion 203 is disposed on the cable 205 and adjacent to the pin 202.

The pin 202 is configured for inserting into a hole of a connector jock (not shown) to make an electronical connection with the connector jack.

The cable 205 is made of flexible material, and is placed between the upper shell 200 and the lower shell 201 in an S-shaped configuration. A first protrusion 207 and a second protrusion 209 are protruded from the circumferential surface of the cable 205. When the cable 205 is fixed between the first cutout 224 of the upper shell 200 and the second cutout 214 of the lower shell 201, the second protrusion 209 resists the outside of the upper shell 200 and the lower shell 201, and the first protrusion 207 locates insider of the upper shell 200 and the lower shell 201. That is, the portion of the cable 205 between the first protrusion 207 and the second protrusion 209 is fixed between the first cutout 224 of the upper shell 200 and the second cutout 214 of the lower shell 201 fixing the cable 205 in place. In the exemplary embodiment, the diameter of the cable 205 is approximately equal to the diameter of the hole formed by the first cutout 224 and the second cutout 214.

The threaded fixing portion 203 is frustum shaped, and the size of the threaded fixing portion 203 gradually increases along a direction from the cable 205 to the pin 202. The size of the threaded fixing portion 203 adapts to the size of a groove formed by the first threaded groove 222 with the second threaded groove 212, so that, the threaded fixing portion 203 can be received between the first threaded groove 222 and the second threaded groove 212, and the pin 202 is movable to relative to the shell 100.

When the connector plug 10 is not used, the threaded fixing portion 203 is received between the first threaded groove 222 and the second threaded groove 212, and the first protrusion 207 locates inside of the upper shell 200 and the lower shell 201, and the second protrusion 209 resists the outside of the upper shell 200 and the lower shell 201.

Figure 5:
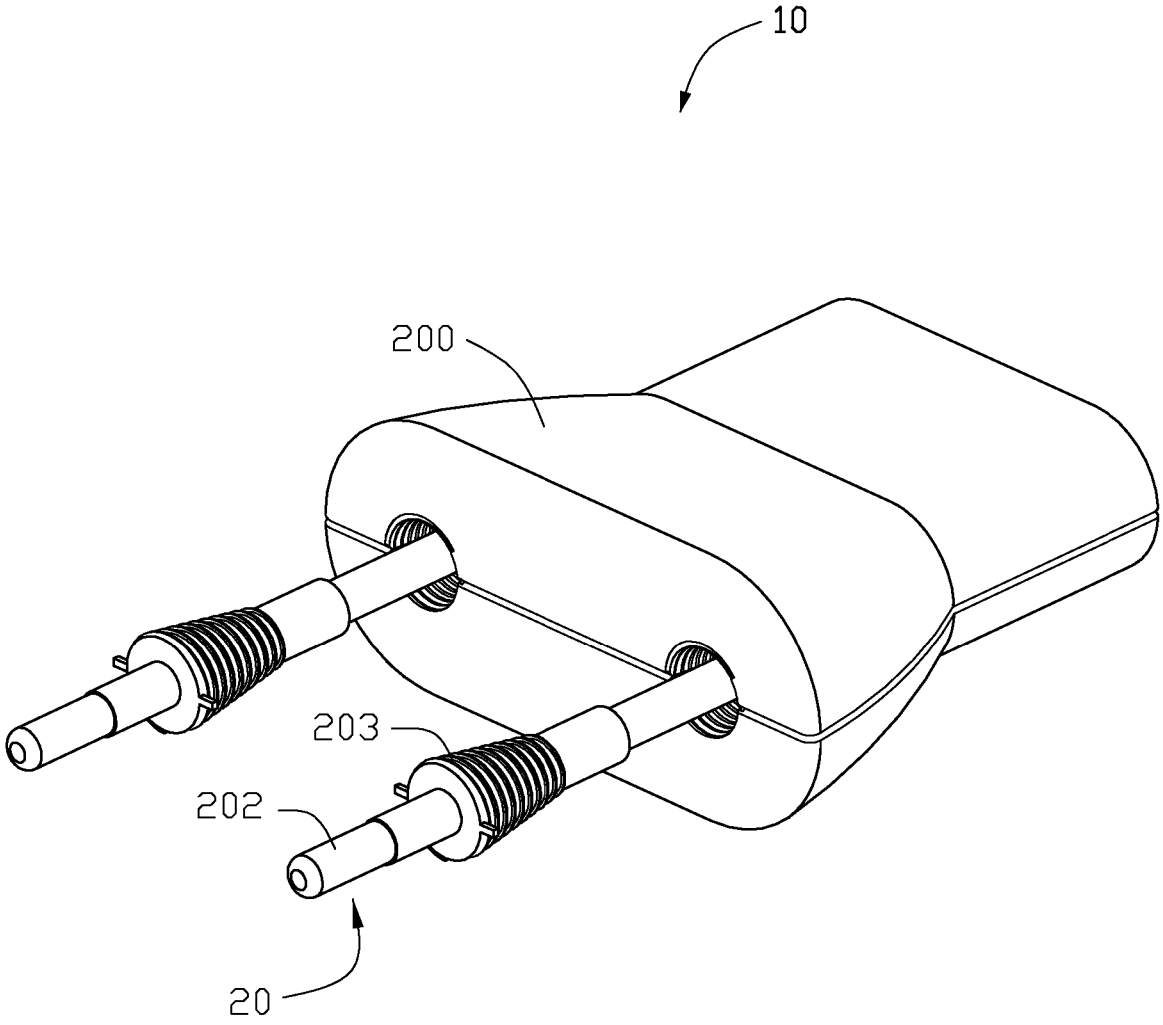
FIG. 5 is an isometric view of the connector plug of FIG. 1 in another state.

Referring to FIG. 5, when the connector plug 10 is used, but there is not enough space on the connector jock for the connector plug 10 to insert, the user can rotate out the threaded fixing portion 203 from the first threaded groove 222 and the second threaded groove 212 of the connector plug 10, so that, the length of the conducting pole 20 exposing from the shell 100 is enough long, thereby inserting the connector jack.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A connector plug comprising:

a shell defining at least two threaded holes; and at least two conducting poles set in an interior of the shell and corresponding to the at least two threaded holes;

wherein each conducting pole comprises a pin extended from the interior of one of the at least two threaded holes, one cable electronically connected to the pin, and one threaded fixing portion fixed on the one cable and adjacent to the pin, and received into the one of the at least two threaded holes.

2. The connector plug as described in claim 1, wherein the number of at least two threaded holes is two, the shell comprises a upper shell and a lower shell, two first threaded grooves are defined in the upper shell, and two second threaded grooves are defined in the lower shell, each threaded groove is semi-frustum shaped with a larger opening facing outside of the shell, the first threaded grooves cooperates with the second threaded grooves to form the two threaded holes each of which is frustum shaped, the threaded fixing portion is frustum shaped, and the size of the threaded fixing portion adapts to the size of the threaded hole.

3. The connector plug as described in claim 2, wherein two first cutouts are defined in the upper shell, and two second cutouts are defined in the lower shell, the first and second cutouts cooperatively form two holes.

4. The connector plug as described in claim 2, wherein the diameter of each cable is approximatively equal to the diameter of each of the holes formed by the first cutouts and the second cutouts.

5. The connector plug as described in claim 3, wherein each cable is fixed in one of the holes formed by the first cutouts and the second cutouts.

6. The connector plug as described in claim 5, wherein the first and second threaded grooves are defined in a first side of the shell, and the first and second cutouts are defined in a second side of the shell opposite to the first side.

7. The connector plug as described in claim 5, wherein a first protrusion is protruded from the circumferential surface of each cable and locates in the interior of the shell.

8. The connector plug as described in claim 7, wherein a second protrusion is protruded from the circumferential surface of the cable and locates in the exterior of the shell, the portion of the cable between the first protrusion and the second protrusion is fixed by one of the holes formed by the first cutouts and the second cutouts.

* * * * *